United States Patent [19]

Hung

[11] 4,155,617

[45] * May 22, 1979

[54] ELECTRIC PLUGS

[76] Inventor: Jui-Jung Hung, 584 Jui Lung Rd., Kaohsiung, Taiwan

[ * ] Notice: The portion of the term of this patent subsequent to Feb. 7, 1995, has been disclaimed.

[21] Appl. No.: 821,483

[22] Filed: Aug. 3, 1977

Related U.S. Application Data

[63] Continuation-in-part of Ser. No. 714,234, Aug. 13, 1976, Pat. No. 4,072,391.

[51] Int. Cl.[2] ..... H01R 11/02

[52] U.S. Cl. ..... 339/196 R

[58] Field of Search ..... 339/196 R, 196 M, 273 R, 339/273 F, 95 R, 95 D, 98, 99 R

[56] References Cited

U.S. PATENT DOCUMENTS

| | | | |
|---|---|---|---|
| 2,083,836 | 6/1937 | Glade, Jr. | 339/196 R |
| 2,283,177 | 5/1942 | Brainard | 339/196 R |
| 4,072,391 | 2/1978 | Hung | 339/99 R |

*Primary Examiner*—Joseph H. McGlynn
*Attorney, Agent, or Firm*—Holman & Stern

[57] ABSTRACT

The plug comprises a plug base having an assembly cavity which has inserted therein two pole contacts through the top portion of the plug base. A squeezing arm is formed on the pole plate for holding the wire in the pre-formed recessed hole. A fixing latch is further provided to fasten the pole contact and wire from the top of the plate. By this squeezing means, the electric wire is fixed sturdily and the plug can be easily assembled.

5 Claims, 8 Drawing Figures

ELECTRIC PLUGS

This is a continuation-in-Part application of Ser. No. 714,234 filed Aug. 13, 1976, now U.S. Pat. No. 4,072,391.

BACKGROUND OF THE INVENTION

The present invention relates to electrical plugs. The conventional plugs are movable and are assembled by means of bolt and nut. Whenever connecting the electric wire, a screw driver must be used to open the plug and the wire must be bent to wind on the bolt of the copper pole. The bolt is then fastened. However, if the winding direction of wire is opposite to the rotation direction of the bolt fastening, it is difficult to fix the wire on the copper pole. This can result in future loosening and poor electrical contact. Such a plug will loosen after periodic service. With the loosening of the bolt, the plug base may be separated from the copper pole. The conventional plug has been found inconvenient as it is operated, connected and assembled. It is unsafe for using. When maintenance is necessary, a screw driver of suitable size must be utilized to connect the electric wire.

Also known in the art is a solid and fixed type plug. However, this type of plug is fixed by filling the electric wire into the plug base. If the copper pole contact plate is separated from the wire within the plug, the plug will then be out of service. Furthermore, the factory produces such a plug with a specific length of wire which may not satisfy the customer's requirement. A wire that is too long will cause waste one that is, too short will need further wire for its connection. If the fixed-type plug is provided with colored wire, the specific wire color may not satisfy the customer's interest.

The conventional movable plug is formed in that the conducting wire is aligned with the copper pole plate for assembly. When plugging such a conventional plug into the socket, the plug may easily be pulled out from the socket if there is a pulling force acting on the conducting wire.

Having reviewed the above-mentioned defects, the present inventor has improved and disclosed the present plug.

SUMMARY OF THE INVENTION

The present invention relates to a plug wherein a plug base is formed with two assembly cavities which allows the insertion of two pole contact plates. A squeezing arm is formed on the pole contact plate to squeeze the wire and connect the power through the pole and the connecting wire. Two fixing latches are further provided to fix the copper pole contact plates and the wires. A squeezing arm is provided at the end of the pole plate so as to press the conducting wire into the assembly cavity pre-formed in the plug base to fix the wire sturdily.

When ever assembling the present plug, the power cable may be pared to remove the outer insulating material to make nude the copper wires. Then the wires are lead to the wire holes to be assembled with the pole plates. It is simple to assemble the plug. The wire may not be drawn and loosened after being fixed by the above-mentioned means.

BRIEF DESCRIPTION OF THE DRAWINGS

In order that the invention may be more readily understood, an embodiment thereof will now be described by way of example, with reference to the accompanying drawings in which.

Figure 1:
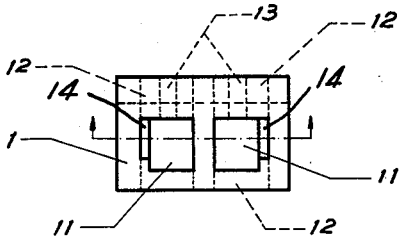
FIG. 1 is a front view of a plug base according to the present invention.
Figure 3:
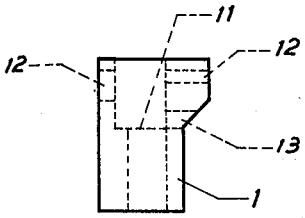
FIG. 3 is a right side view of the plug base.
Figure 2:
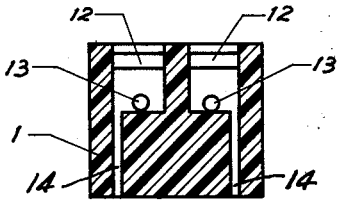
FIG. 2 is a front cross-sectional view of the plug base.
Figure 6:
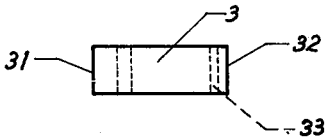
FIG. 6 is a top view of a fixing latch.
Figure 7:
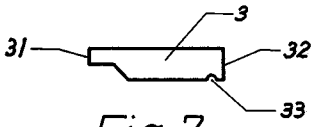
FIG. 7 is a side view of a fixing latch.
Figure 4:
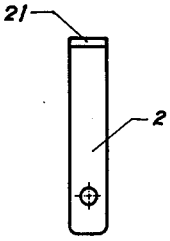
FIG. 4 is a front view of the pole contact plate.
Figure 5:
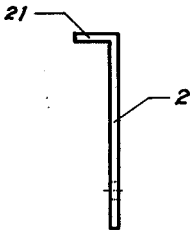
FIG. 5 is a side view of a pole contact plate.

DESCRIPTION OF THE PREFERRED EMBODIMENT:

As shown in the drawings, the present plug comprises a plug base 1, copper contact plates 2, and fixing latches 3.

The plug base 1 is made of an electrical insulating material such as plastic. Assembly cavities 11 are preformed in accordance with the shape of the contact plates 2. After inserting the contact plates 2, the aperture for inserting the wire 4 is formed.

The contact plates 2 are made from copper material. They are pressed to form a wire engaging arm 21, bending 90 degrees from the L-shaped contact body. The arm 21 extends into the assembly recess 11 in the plug base 1 so as to fix the wire 4.

Two wire holes 13 are provided in the plug base 1 to lead the conducting wire therethrough. The holes 13 directly pass through the assembly cavity 11 so that the wire 4 may be forced by the arm 21 of the contact plate 2. Two assembly cavities 11 are provided for the insertion of the two contact plates 2.

At suitable positions on the base 1, tunnels 12 for the insertion of the fixing latches 3 are provided. When the contact plates 2 are inserted into the cavities 11 for fixing the wire, the arm 21 of the contact plate 2 is forced by the fixing latch 3 so as to pressurize and trap the wire into the aperture between the arm 21 and the assembly cavity 11. The contact plate can not be retracted any more so that the plug will be stabilized.

The assembly cavities 11 are provided with contact slots 14 and recesses for the insertion of the pole plates 2. A partition is located between the assembly cavities to prevent a short-circuit from the contacting of the two wires.

Figure 8:
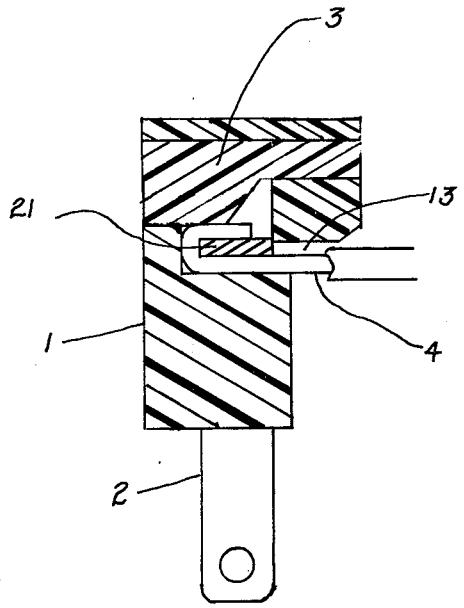
FIG. 8 is a cross-sectional view of the plug assembly after being fixed.

The fixing latch 3 is made of an insulating material such as plastic. The two fixing latches 3 are inserted through the tunnels 12 provided at a suitable position of the base 1. If the contact plate 2 is inserted into the assembly cavity 11, the back of the arm 21 may be forced by the fixing latch 3 so as to pressurize the wire 4 into the aperture between the arm 21 and the fixing latch 3 and make the wire 4 bend around the arm 21 (FIG. 8). Therefore, not only will the wire 4 not be easily loosened, but also the contact dimension between the contact plate 2 and the wire 4 may thus be increased so that it results in better conductivity. The fixing latch 3 has a special shape of a little curved-in surface in the head part 32 so as to insert the same smoothly into the tunnel 12. There is provided a groove 33 in the tail portion, enabling the latch 3 to be pulled out of the hole without much difficulty. When utilizing the plug 1, the following procedures may be applied.

(a) Loosely insert the two contact plates 2 into the assembly cavities 11 of the plug base 1.

(b) Strip the insulating material of the power line to bear the copper wires. Then twist the wires to make it as dense as a cable.

(c) Lead the above-mentioned wound wire 4 through the hole 13 and then lead it into the bottom hole of the arm 21 of the contact plate.

(d) Press down the contact plates 2. The arm 21 will force the wire 4 against the engaging surface a make it bend around.

(e) Insert the fixing latch 3 through tunnel 12 to the specific position to complete the assembly of the plug.

There are several changes which may be made without departing from the spirit and scope of the invention described in the foregoing specification and claimed in the following claims.

What is claimed is:

1. An electrical plug comprising a plug base, two fixing latches and two contact plates:

said plug base having two assembly cavities therein, two contact slots perpendicular to said assembly cavities, two latch tunnels and two wire holes;

each said contact plate being substantially L-shaped with one arm extending through one of said contact slots and the other arm positioned in one of said assembly cavities;

said wire holes extending from one side of the plug base into the assembly cavities, whereby when wires are inserted into said wire holes and said contact plates are inserted through said assembly cavities into said contact slots, the said other arm engages the wire and when said fixing latches are inserted into said latch tunnels, said latches fix the wire against said other arm.

2. The electric plug of claim 1 wherein said latch tunnels are aligned parallel to each other and perpendicular to said contact slots.

3. The electric plug of claim 1 wherein said fixing latches each comprise a head portion, a center portion and a tail portion, said head portion having a curvingly reduced cross-section and said tail portion has a transverse groove.

4. The electric plug of claim 1 wherein said contact plates are made of copper.

5. The electric plug of claim 1 wherein said plug base and said fixing latches are made of a plastic.

* * * * *